United States Patent [19]

O'Hara et al.

[11] Patent Number: 4,647,260

[45] Date of Patent: Mar. 3, 1987

[54] DEPTH-ADJUSTING SYSTEM FOR A POWER TOOL

[75] Inventors: Frank O'Hara, Hanover, Pa.; John W. Miller, Parkton, Md.

[73] Assignee: Black & Decker Inc., Newark, Del.

[21] Appl. No.: 589,707

[22] Filed: Mar. 15, 1984

[51] Int. Cl.[4] ..... B25B 21/00

[52] U.S. Cl. ..... 408/241 S; 408/113; 408/202; 81/429

[58] Field of Search ..... 409/184, 214, 218, 221; 408/113, 116, 14, 202, 241 S; 81/429; 74/89.15, 424.8 R

[56] References Cited

U.S. PATENT DOCUMENTS

| | | | |
|---|---|---|---|
| 1,013,438 | 1/1912 | Post | 279/50 |
| 2,346,706 | 4/1944 | Stoner | 279/46 |
| 2,381,087 | 8/1945 | Stewart | 408/113 |
| 2,711,324 | 6/1955 | Andreasson | 279/5 |
| 3,527,273 | 9/1970 | Falter | 81/429 |
| 3,712,352 | 1/1973 | Lafferty, Sr. | 81/429 |
| 3,969,960 | 7/1976 | Pagano | 81/429 |

FOREIGN PATENT DOCUMENTS

| | | | |
|---|---|---|---|
| 560507 | 4/1944 | United Kingdom | 408/202 |
| 565964 | 12/1944 | United Kingdom | 408/241 B |

*Primary Examiner*—Z. R. Bilinsky
*Assistant Examiner*—Daniel W. Howell
*Attorney, Agent, or Firm*—Edward D. Murphy; J. Bruce Hoofnagle; Charles E. Yocum

[57] ABSTRACT

A depth-adjusting system for a power tool includes a housing nose portion on which is snapped a two-piece, molded plastic depth-adjusting subassembly. Each member of the subassembly engages a respective area of the nose portion. An adjustment member is rotatably connected to the nose portion, but is releasably restrained from axial movement upon engagement with a split-ring detent on the nose portion. A locator member is threadably connected inside the adjustment member, but is restained from rotating through the interaction of integral keys formed on its interior cylindrical surface with mating longitudinal keyways formed on the nose portion. Thus when the operator rotates the adjustment member, the locator member is forced to move axially forwardly or rearwardly, depending upon the direction of rotation of the adjustment member. Another feature of this system is the use of protuberances integrally formed in the rear axial end of the locator member to inhibit lock-up between the locator member and the adjustment member after the locator member has been drawn inwardly to its rearmost position.

14 Claims, 12 Drawing Figures

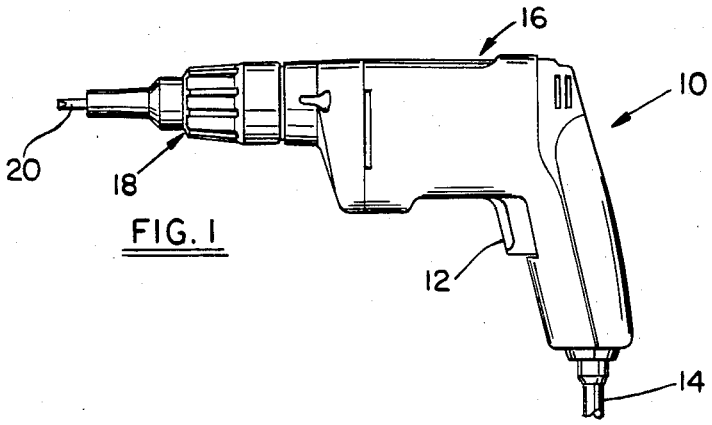
FIG. 1
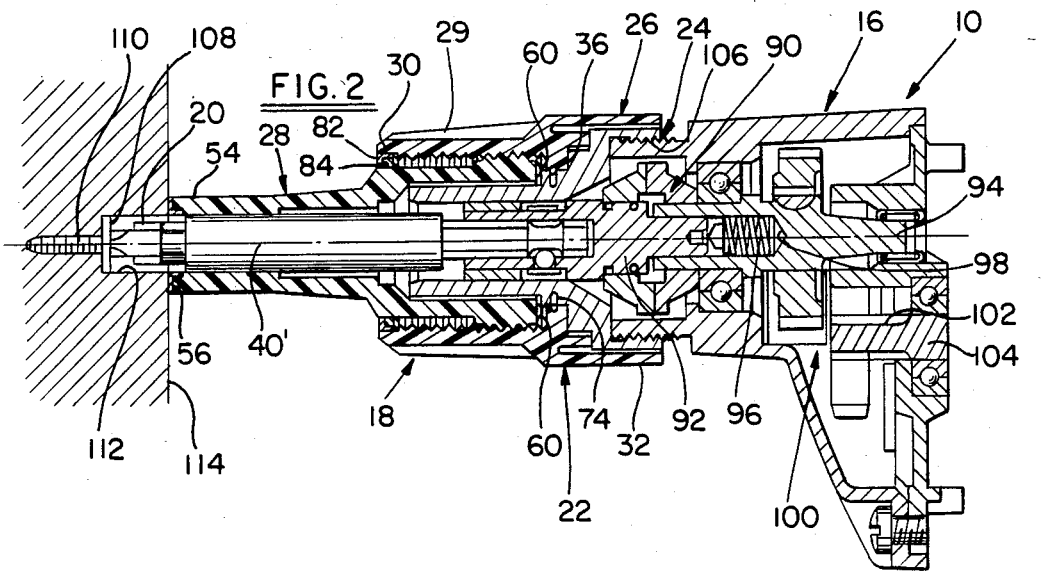
FIG. 2
FIG. 3
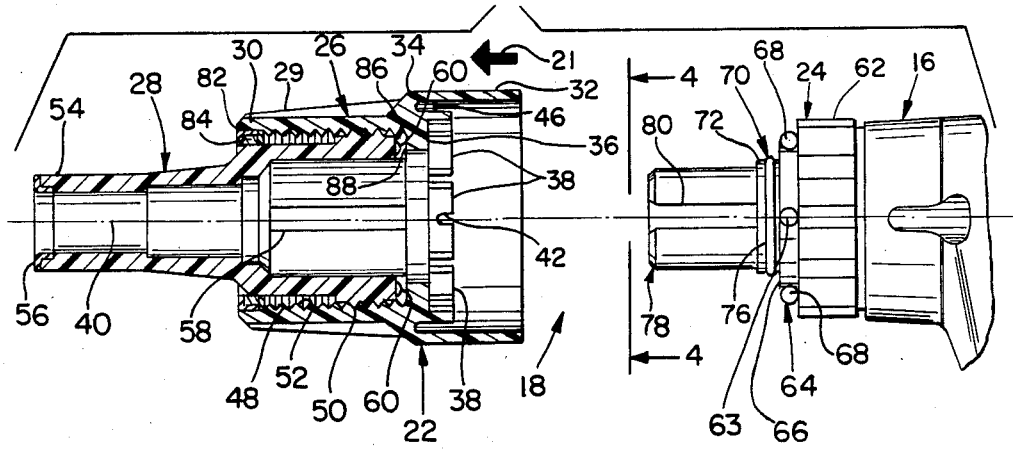

PRIOR ART

DEPTH-ADJUSTING SYSTEM FOR A POWER TOOL

BACKGROUND OF THE INVENTION

1. Field of the Invention

This invention relates to depth-adjusting systems for tools, particularly to depth-adjusting systems for power driven screwdrivers, in which a subassembly including two molded plastic parts is connected to the nose portion of the screwdriver with a snap-action, permitting quick replacement of a screwdriver bit without disturbing the depth setting.

2. Description of the Prior Art

Previous depth-adjusting systems have included complicated, spring-biased mechanisms which have required several machined parts, as well as a certain degree of care by the operator to avoid losing the parts during disconnection of the system.

Another prior art system includes a two-piece plastic subassembly. One piece is a collar which is rotatably connected to the housing of a power tool and includes an internal thread. The other is a small-diameter depth locator member rotatably connected to the collar using the same thread as is used to connect the collar to the housing. Ridges on the locator member engage longitudinal ribs formed on the interior of the collar to maintain a particular depth setting. While this prior art depth locating system does permit an operator to replace the bit without having to change the depth setting on the depth locator, the operator must nevertheless assemble the depth locator to the housing of the tool by rotating the collar through several turns, thereby taking an additional increment of time. Furthermore, because the operator must change the depth setting by rotating the depth locator member relative to the fixed, large-diameter collar, very little mechanical advantage is available to the operator, who must use significant force to overcome the interaction of the ridges on the locator with the respective longitudinal ribs formed on the collar.

SUMMARY OF THE INVENTION

The depth-adjusting system of the present invention includes a subassembly having two molded plastic members, both of which are connected to the nose portion of a housing of a power tool. The subassembly is mounted on the nose portion coaxial with a tool bit so that one of the members of the depth-adjusting subassembly is restrained from axial movement but is free to rotate relative to the nose portion. The other member is connected to the nose portion such that it is restrained from rotating, but on the other hand is free to move axially relative to the housing, responsive to rotation of the first member. The result is a depth-adjusting system which does not require the operator to disturb a previously-set adjustment merely to change tool bits. Furthermore, the system permits the operator to connect one of the members of the subassembly to the nose portion with a snap-action using a single axial motion; it further provides a relatively large mechanical advantage by enabling the operator to adjust the depth of the system by rotating a large diameter collar member relative to a smaller diameter locator member.

It is an object of the present invention to provide a depth-adjusting system for a power tool which overcomes the prior art disadvantages; which is simple, economical, and reliable; which includes a nose portion having a axis and connected to a housing, an adjustment member rotatable connected to the nose portion, and a locator member slideably connected to the nose portion; which includes linking means for axially moving the locator member relative to the nose portion responsive to rotation of the adjustment member; which linking means includes first means operatively associated with the nose portion and the locator member for releasably restraining the locator member from rotation consequent to said rotation of the adjustment member; which includes a longitudinal key-way formed on the nose portion and a mating key formed on the locator member; which linking means further includes second means operatively associated with the nose portion and the adjustment member for releasably restraining the adjustment member from axial movement relative to the nose portion; which includes an internal annular flange engageable in a snap-action with a retaining ring connected to the nose portion; which depth-adjusting system further includes indexing means operatively associated with the adjustment member and the nose portion for releasably maintaining the adjustment member in a predetermined angular position relative to the nose portion; which indexing means includes a plurality of resilient fingers axially formed on the adjustment member and engageable with detent means formed on the nose portion; which depth-adjusting system further includes anti-locking means for inhibiting the locator member from locking-up with the adjustment member consequent to movement of the adjustment member through a predetermined distance; which includes a protuberance formed on one axial end of the locator member and engageable with an opposing surface on the adjustment member. The depth-adjusting system further includes sealing means operatively associated with the adjustment member and the locator member for inhibiting the flow of foreign particles into the housing.

Other objects and advantages will be apparent from the following description of one embodiment of the invention; the novel features will be particularly pointed out hereinafter in the claims.

BRIEF DESCRIPTION OF THE DRAWINGS

The invention is illustrated in the accompanying drawings in which:

FIG. 1 is a side elevational view of a power tool, namely a screwdriver, embodying the present invention.

FIG. 2 is a side elevational sectional detail view of the depth-adjusting system of the present invention.

FIG. 3 is an exploded elevational detail view of the depth-adjusting system of the present invention.

DESCRIPTION OF THE PREFERRED EMBODIMENT

Figure 4:
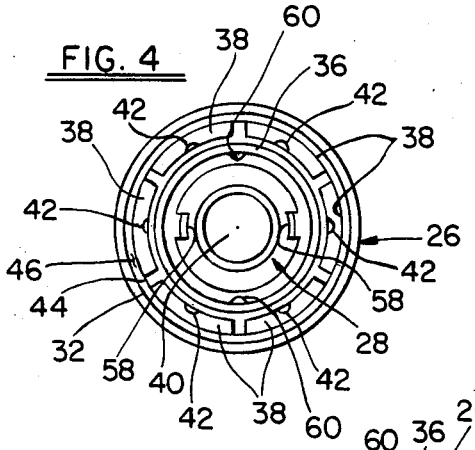
FIG. 4 is an elevational detail view of the depth-adjusting subassembly taken along line 4—4 of FIG. 3, showing the resilient indexing fingers of the present invention.

Referring to FIG. 1, a power tool such as a power screwdriver is shown embodying the present invention and is referred to generally as 10. The tool 10 is powered by a motor (not shown) actuated by a trigger switch 12 which controls electrical energy provided to the motor through the power cord 14. The power tool 10 includes a housing 16 to which is connected the depth-adjusting system 18 of the present invention. A tool bit 20 having a predetermined axial length is connected to the power tool 10 and extends outwardly from the depth-adjusting system 18. With reference to FIGS. 3 and 4, the elements of the depth-adjusting system 18 include a depth-adjusting subassembly 22 connected with a snap-action to a nose portion 24 of the housing 16. The arrangement of the depth-adjusting system 18 permits an operator to easily remove the depth-adjusting subassembly 22, such as for the purpose of replacing the tool bit 20, without disturbing the depth-adjustment setting and without requiring more than a simple axial motion, indicated by arrow 21, to separate (or re-connect) the depth-adjusting subassembly 22 from (or to) the nose portion 24. This is accomplished by interconnecting the elements of the depth-adjusting subassembly 22 so that it is removable from the nose portion 24 as a unit. Specifically, the depth-adjusting subassembly 22 includes a first member, namely, a molded plastic adjustment member or collar 26, which carries with it a second member, namely, a molded plastic locator member or depth locator 28. The adjustment collar 26 is a one-piece molded plastic member having a front cylindrical portion 30 connected to a rear cylindrical portion 32 at a junction 34. The adjustment collar further includes an internal annular flange 36 formed adjacent the junction 34 and a plurality of resilient indexing fingers 38 extending axially rearwardly of the internal flange. The indexing fingers 38 are radially equidistant from an axis 40 of the housing 16 and depth-adjusting subassembly 22, and are also equidistant from the axis of the tool bit 40, which is itself coaxial with the depth-adjusting subassembly and nose portion 24 of the housing. The fingers 38 are provided with notches 42 to enhance their resiliency. FIG. 4 illustrates that the diameter of the circle 44 defined by the indexing fingers 38 is less than that of the rear cylindrical portion 32 and greater than that of the internal flange 36, thereby defining a clearance space 46 between the fingers and the rear cylidrical portion of the adjustment collar 26. The front cylindrical portion 30 defines a set of internal depth-adjusting threads 48 which engage mating threads 50 formed on the rear external surface 52 of the depth locator 28, the second member of the depth-adjusting subassembly 22.

A workpiece-engaging portion 54 includes a wear surface, such as a metal insert 56, and is formed forwardly of the external threads 50. Again with respect to FIG. 4, the depth locator 28 further defines a pair of longitudinal integral keys 58 as well as anti-locking means 60 for inhibiting the depth locator from locking-up with the adjustment collar 26 consequent to movement of the adjustment collar through a predetermined distance. The anti-locking means 60 will be described in later detail.

The remaining element of the depth-adjustment system 18 is nose portion 24, which includes an annular assembling grip portion 62 adjacent the housing 16, and a first detent portion 64 defined by a first annular surface 66 of a first predetermined diameter and having a plurality of bumps 68 formed thereon. The nose portion 24 further includes a second detent portion 70 having a second annular surface 72 of a second predetermined diameter formed forwardly of the first detent portion 64. The second annular surface 72 defines an annular groove 74 in which is mounted a resilient split retaining ring 76. The nose portion 24 also includes a front portion 78 extending axially forwardly of the second detent portion 70 and defining two axially-extending grooves or keyways 80 complementary with the longitudinal keys 58 integrally formed in the depth locator 28. When the depth-adjusting subassembly 22 is snapped onto the nose portion 24, the respective surfaces of the subassembly and the nose portion coact as follows: Looking now at FIGS. 2 and 5, the rear cylindrical portion 32 of the depth-adjusting collar 22 fits over the assembling grip portion 62 of the nose portion 24. Simultaneously the resilient fingers 38 of the adjustment collar engage the bumps 68 formed on the first detent portion 64, and the internal keys 58 of the depth locator 28 engage the complementary keyways 80 on the front portion 78 of the nose portion 24. As the depth-adjusting subassembly 22 is moved an additional axial distance onto the nose portion 24, the internal annular flange 36 formed on the adjustment collar 26 encounters the second detent portion 70. When that happens the split retaining ring 76 compresses slightly, allowing the internal annular flange 36 to engage the second detent portion 70 with a snap action.

Figure 5:
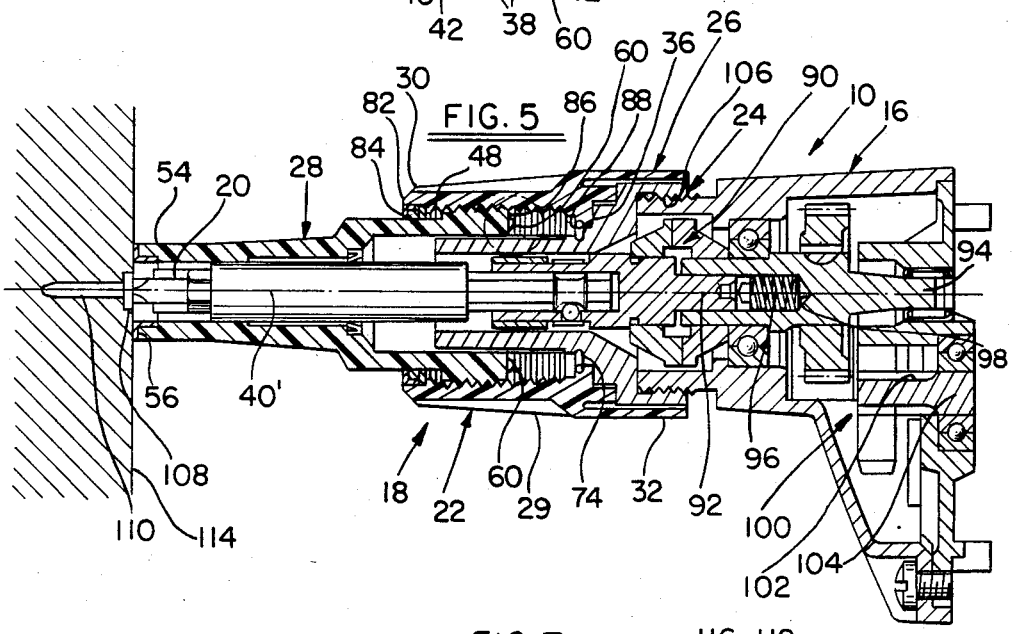
FIG. 5 is a elevational sectional detail view of the depth-adjusting system shown in FIG. 2, with the depth locator set at a position to permit a smaller depth than that allowed by the setting in FIG. 2.

Again with respect to FIG. 3, and also with respect to FIGS. 2 and 5, once the depth-adjusting subassembly 22 has been connected to the nose portion 24 of the housing 16 of the power tool 10, it can be seen that the resilient fingers 38 of the adjustment collar 26 releasably maintain the adjustment collar in a predetermined angular position relative to the nose portion, as they coact with the bumps 68 on the first detent portion 64. Furthermore, the coaction of the internal annular flange 36 of the adjustment collar 32 with the retaining ring 76 releasably restrains the adjustment collar from axial movement relative to the nose portion 24.

After the depth-adjusting subassembly 22 has been connected to the nose portion 24, an incremental rotation of the depth-adjustment collar 26 from one angular postion to another relative to the nose portion produces an incremental axial movement of the depth locator 28 relative to the nose portion, thereby achieving the desired depth setting with a high degree of accuracy. This occurs because the depth locator 28 is restrained from rotating in concert with the adjustment collar 26, through the interaction of its integral keys 58 with the mating keyways 80 on the nose portion 24. Therefore rotation of the adjustment collar internal threads 48 over the depth locator external threads 50 forces the depth locator 28 to move axially inwardly or outwardly relative to the nose portion 24, depending upon the direction of rotation of the collar 26.

In summary, the depth locator 28 is provided with integral linking means for axially moving the depth locator relative to the nose portion responsive to rotation of the adjustment collar 32. The linking means includes first means (such as the keys 58) for releasably restraining the depth locator 28 from rotation consequent to the rotation of the adjustment collar 32, and second means (such as flange 36) for releasably restraining the adjustment collar from axial movement relative to the nose portion 24. The linking means further include the various previously-described threads 48, 50. Also it can be seen that the depth-adjusting system 18 includes indexing means (such as the indexing fingers 38) operatively associated with the adjustment collar 26 and the nose portion 24, for releasably maintaining the adjustment collar in a predetermined angular position relative to the nose portion.

Again with respect to FIGS. 2, 3, and 5, the depth-adjusting system 18 further includes sealing means operatively associated with the adjustment collar 32 and the depth locator 28 for inhibiting the flow of foreign particles into the housing 16. As shown in FIG. 3, the sealing means can be of the form of an annular member 82 containing appropriate sealing material 84 such as felt.

Figure 6A:
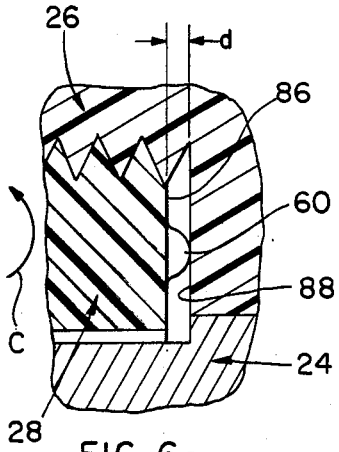
FIGS. 6A through 6C are enlarged schematic sequential detail views of the operation of the anti-locking means of the present invention, taken at the circled portion of FIG. 2.
Figure 6B:
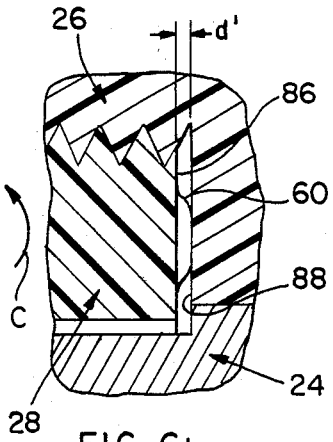
Figure 6C:
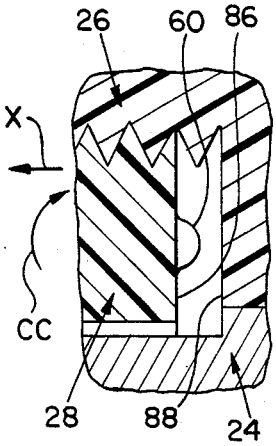

Now that the basic elements of the depth-adjusting system have been described, it is appropriate to discuss in more detail the system's anti-locking means 60, which are shown in FIGS. 2, 3, 4 and 5. It had been discovered that when an operator rotated the adjustment collar 26 to move depth locator 28 its extreme inward position relative to the adjustment collar, the depth locator would often lock-up with the adjustment collar, requiring the operator to use a high amount of force to disengage the parts. As a result, anti-locking means 60 were discovered which solved the problem, as follows:

With respect to FIGS. 3, 4 and 5, a rear axial end face 86 of the depth locator defines a first stop surface, and a forwardly-facing portion 88 of the adjustment collar's internal annular flange 36 defines a second, opposing stop surface. As noted above, in the absence of the anti-locking means 60 of the present invention, continued rotation of the adjustment collar 26 would draw the respective opposing stop surfaces into close proximity to one another, and ultimately into tight engagement, often resulting in lock-up. The anti-locking means includes a pair of protuberances 60 integrally molded on the first stop surface. Now when the adjustment collar 26 is rotated to draw the depth locator 28 to its inwardmost limit, the protuberances engage the second stop surface in advance of any engagement by the first stop surface. One possible explanation for the operation of the anti-locking means 60 is shown in FIGS. 6*a* through 6*c*. The protuberances 60 on the depth locator 28 engage the second stop surface when the two members 26, 28 are in close proximity, as is illustrated in FIG. 6*a*, following rotation of the collar, as indicated by arrow "c" in FIG. 6*a* FIG. 6*b* illustrates the result as the operator continues to rotate one member relative to the other, thereby reducing the distance between the two respective stop surfaces from "d" (FIG. 6*a*) to that designated as "d" (FIG. 6*b*). Thus one explanation is that the protuberances 60 deform slightly to accommodate the continued relative axial movement of the members. Upon rotation of one of the members in the opposite direction (arrow "cc" in FIG. 6*c*), the resilience of the protuberances 60 helps spring the two members apart (arrow "x", FIG. 6*c*), thereby inhibiting the lock-up phenomenon from occuring.

Figure 7:
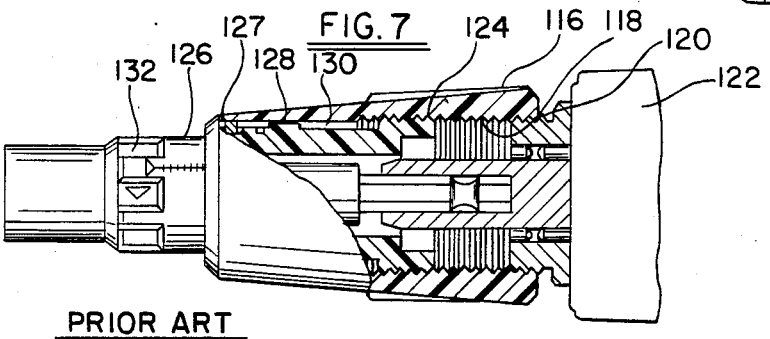
FIG. 7 is an elevational sectional detail view partially cut away, of a prior art depth-adjusting nosepiece for a screwdriver.
Figure 7A:
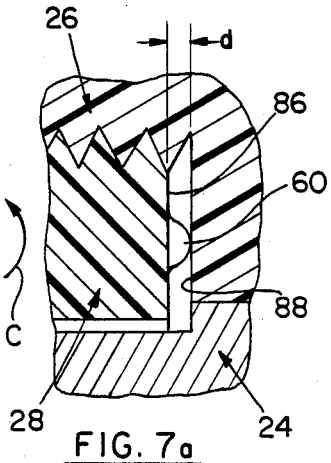
FIGS. 7A through 7C are enlarged schematic sequential detail views depicting another explanation for the operation of the elements of the anti-locking means of the present invention.
Figure 7B:
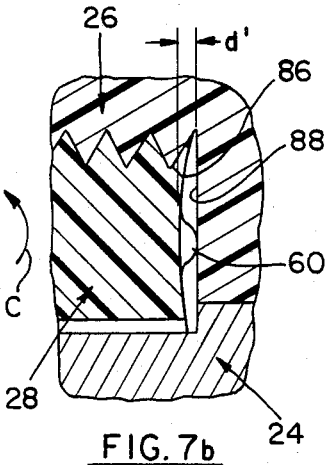
Figure 7C:
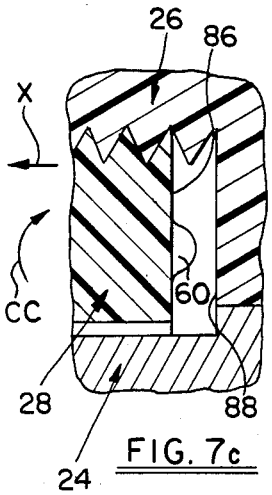

Another possible explanation of the operation of the anti-locking means 60 is illustrated in FIGS. 7*a* through 7*c*. Here the protuberances 60 are not more resilient than the materials of the respective stop surfaces; instead, as illustrated in FIG. 7*b* one or the other of the stop surfaces deforms. The result as shown in FIG. 7*c* is the same as that as illustrated in FIG. 6*c*, namely, upon rotation of one of the subassembly members 26, 28 relative to the other, the relative resiliency generated between the two members by the action of the anti-locking means 60 actually assists in springing the two apart (arrow "x", FIG. 7*c*).

Having described the elements and operation of the depth-adjusting system 18 of the present invention, it can be appreciated that it is not restricted for use with power tools, but is also appropriate for use with manually operated tools. That is because the depth-adjusting system of the present invention is completely independent of the drive means, or of the type of tool bit used (i.e., screwdriver, nut-runner, etc.). However, for purposes of illustration, the depth-adjusting system 18 of the present invention is shown in use with a power screwdriver 10, as shown in FIGS. 2 and 5. Here the screwdriver bit 20 is driven through a clutch system 90 in which a screwdriver bit holder 92 is spring-biased outwardly from a drive spindle 94 by a coil spring 96 mounted in a blind axial bore 98 formed in the spindle. The spindle 94 is powered through a gear train 100 which is driven by a drive pinion 102 formed on the motor's armature shaft 104. FIGS. 2 and 5 also show that the nose portion 24 is threadably connected to the housing 16 at 106. However, it can be appreciated that the nose portion 24 may instead simply be formed integrally with the rest of the housing 16. Following is a discussion of the operation of the depth-adjusting system 18 in combination with the power screwdriver shown in FIGS. 2 and 5.

FIG. 2 shows the adjustment collar 26 rotated such that the depth locator 28 has approached its rear-most axial position, which will yield the greatest depth to which the head 108 of a fastener 110 may be driven. With this setting, the fastener head 108 will be driven inwardly to the position shown in FIG. 2, within a counterbore 112, until the workpiece-engaging portion 54 of the depth locator 28 engages a work surface 114. That engagement prevents additional axial movement of the screwdriver bit 20 (with the clutches 90 engaged). However in FIG. 5, the adjustment collar 26 is shown rotated so that the depth locator 28 has approached its outermost axial position relative to the nose portion 24. The result is that, with the clutches 90 engaged, when the workpiece-engaging portion 54 of the depth locator 28 engages the work surface 114, the screwdriver bit is prevented from driving the head 108 of the fastener 110 beyond the position shown in FIG. 5, such that the head 108 of the fastener 110 remains flush with the exterior of the work surface 114. It can be seen that this screwdriving mechanism can be replaced by other mechanisms, such as a nut-running mechanism, and coupled to the depth-adjustment system 18, so that female fasteners can be driven to any depth relative to the exterior surface of a work surface, similar to the operation of the screwdrivers shown in FIGS. 2 and 5.

Several advantages can be realized from the use of its depth-locating system 18 of the present invention. One is that the operator can change screwdriver bits without disturbing a previously-selected depth setting. As shown in FIG. 3 the depth-adjusting subassembly 22 is removed simply by axially pulling the adjustment collar 26 out of its snap-action engagement with the nose portion 24. Since there is no turning motion involved in removing the depth-adjusting subassembly 22 the axial position of the depth locator 28 relative to the adjustment collar 26 remains unchanged. This also illustrates another advantage, the ease of connection and disconnection of the subassembly from the screwdriver housing. A third advantage is in providing a relatively large-diameter gripping surface, which sufficiently maintains the angular position of the depth-adjusting collar relative to the nose portion without requiring the operator to expend significant energy in changing the setting. A fourth advantage results because the anti-locking means 88 of the present invention permits the use of two one-piece molded plastic members to make up the depth-adjusting subassembly, yet enables the operator to avoid an attendant lock-up problem between the two members. A fifth advantage is that by reducing the number of parts in the depth-adjusting subassembly, the manufacturing costs are minimized.

By contrast the prior art depth adusting system shown in FIG. 7 also employs a two-piece subassembly, but does not include many of the previously-enumerated advantages of the present invention. For example, the collar 116 shown in FIG. 7 defines a set of internal threads 118 which engage threads 120 formed on a tool housing 122, as well as those threads 124 formed on the exterior of a depth locator member 126. The depth locator member 126 further includes a seal 127 and a plurality of exterior ridges 128 formed forwardly of the threads 124. These ridges 128 engage a plurality of internal longitudinal ribs 130 formed on the interior of the collar 116. The purpose of the ridges 128 and the ribs 130 is to releasably hold the depth locator 126 in a predetermined angular position relative to the collar 116. A handgrip 132 is formed on forward portion of the depth locator member 126. Thus, when the operator wishes to connect the depth adusting subassembly shown in FIG. 7 to the housing 122 he or she must first rotate the collar 116 a sufficient number of turns until the collar is snugly mounted on the housing 122. Thereafter the collar itself plays no active role in varying the axial location of the depth locator member 126 relative to the housing 122. After the collar 116 is rotatably attached to the housing 122, the operator must grip the small handgrip 132 and rotate it against the comparatively stiff resistance of the interaction of the ridges 128 on the locator with the internal longitudinal ribs 130 of the collar. Thus, unlike the present invention, the depth-adjusting system shown in FIG. 7 includes a member 116 which is attached to the housing 122 such that it is not free to move either axially or rotatably relative to the housing, except to disassemble the unit. The other member 126 is connected not to the housing 122, but to the collar 116 for both axial and rotating movement relative to the collar.

On the other hand the depth-adjusting system of the present invention, as previously illustrated, permits a two-piece depth-adjusting subassembly to be connected to a nose portion of a housing simply by following these steps: slipping the depth-adjusting subassembly coaxially over the tool bit; connecting one of the members of the depth-adjusting subassembly to the nose portion such that the one member is restrained from axial movement but is free to rotate relative to the nose portion; and connecting the other of the two members to the nose portion such that the other member is restrained from rotating but is free to move axially relative to the nose portion. Thus in the depth-adjusting system 18 of the present invention both the adjustment collar 26 and the depth locator 28 are operatively connected to the nose portion 24 of the power tool 10.

It will be understood that various changes in the details, materials, arrangements of parts and operating conditions which have been herein described and illustrated in order to explain the nature of the invention, may be made by those skilled in the art within the principles and scope of the invention.

What is claimed is:

1. A depth-adjusting system for a power tool having a housing, comprising:

(a) a nose portion connected to the housing, and having an axis;

(b) an adjustment member connected to the nose portion for rotatable, non-axial movement relative to the nose portion during depth-adjusting movement of the adjustment member;

(c) a locator member connected to the nose portion for axially slidable, non-rotatable movement relative to the nose portion during depth-adjusting movement of the adjustment member, and including linking means for axially moving the locator member relative to the nose portion responsive to rotation of the adjustment member; and (d) the linking means including means operatively associated with the nose portion and the locator member for releasably restraining the locator member from rotating consequent to said rotation of the adjustment member.

2. The depth-adjusting system claimed in claim 1, further comprising:

indexing means operatively associated with the adjustment member and the nose portion for releasably maintaining the adjustment member in a predetermined angular position relative to the nose portion for the rotatable, non-axial movement.

3. The depth-adjusting system claimed in claim 1, wherein the means for restraining is a first means, further comprising:

second means operatively associated with the nose portion and the adjustment member for releasably restraining the adjustment member from axially moving relative to the nose portion during the depth-adjusting movement of the adjustment member.

4. The depth-adjusting system claimed in claim 1, further comprising:

sealing means operatively associated with the adjustment member and the locator member for inhibiting the flow of foreign particles into the housing.

5. The depth-adjusting system claimed in claim 1, wherein:

the linking means further including a threaded portion formed on the exterior of the locator member engaging a complementary threaded portion formed on the interior of the adjustment member.

6. The depth-adjusting system claimed in claim 1, wherein the means for restraining including a longitudinal key formed on the locator member engaging a mating keyway in the nose portion.

7. A screwdriver having a housing, comprising:

(a) a nose portion connected forwardly of the housing and including a first detent portion and a front portion;

(b) a bit rotatably connected to the screwdriver adjacent the nose portion along an axis and having a predetermined axial length;

(c) an adjustment collar connected to the housing nose portion coaxial with the bit, and having an internal threaded portion, the adjustment collar connected to the nose portion for rotatable, non-axial movement during depth-adjusting movement of the adjustment collar;

(d) a depth locator connected to the front portion of the nose portion for axial movement relative to the bit, the depth locator connected to the nose portion for slideably axial, non-rotatable movement during depth-adjusting movement of the adjustment collar;

(e) the depth locator including a workpiece-engaging portion and an exterior threaded portion operatively engageable with the adjustment collar internal threaded portion;

(f) the depth locator axial movement being responsive to rotation of the adjustment collar; and (g) the adjustment collar further including a plurality of resilient indexing fingers engageable with the first detent portion of the nose portion, whereby the adjustment collar is releasably maintained in a predetermined angular position relative to the nose portion.

8. The screwdriver claimed in claim 7, wherein:

(a) the nose portion further including a second detent portion and a longitudinal keyway in the front portion;

(b) the adjustment collar further including an internal flange engageable with the second detent portion to releasably restrain the adjustment collar from axially moving relative to the nose portion; and (c) the depth locator defining a key in mating engagement with the keyway.

9. The screwdriver claimed in claim 8, wherein:

(a) the depth locator including a molded plastic member having a rear axial end surface; and further comprising (b) anti-locking means formed on the depth locator rear axial end surface and engageable with the adjustment collar internal flange for inhibiting the depth locator from locking-up with the adjustment collar consequent to movement of the adjustment collar through a predetermined distance.

10. A method for connecting a depth-adjusting subassembly having two members to the nose portion of a housing of a tool, comprising the steps of:

(a) connecting one of the members of the depth-adjusting subassembly to the nose portion such that said one member is restrained from moving axially, but is free to rotate, relative to the nose portion; and (b) connecting the other of said members to the nose portion such that said other of said members is restrained from rotating, but is free to move axially, relative to the nose portion.

11. A depth-adjusting system for a power tool having a housing, comprising:

(a) a nose portion connected to the housing, and having an axis;

(b) an adjustment member connected to the nose portion for rotatable, non-axial movement relative to the nose portion during depth-adjusting movement of the adjustment member;

(c) a locator member connected to the nose portion for axially slidable, non-rotatable movement relative to the nose portion during depth-adjusting movement of the adjustment member, and including linking means for axially moving the locator member relative to the nose portion responsive to rotation of the adjustment member;

(d) the linking means including means operatively associated with the nose portion and the locator member for releasably restraining the locator member from rotating consequent to said rotation of the adjustment member;

(e) indexing means operatively associated with the adjustment member and the nose portion for releasably maintaining the adjustment member in a predetermined angular position relative to the nose portion for the rotatable, non-axial movement; and (f) the indexing means including a plurality of resilient axial fingers formed on the adjustment member and engageable with detent means formed on the nose portion.

12. A depth-adjusting system for a power tool having a housing, comprising:

(a) a nose portion connected to the housing, and having an axis;

(b) an adjustment member connected to the nose portion for rotatable, non-axial movement relative to the nose portion during depth-adjusting movement of the adjustment member;

(c) a locator member connected to the nose portion for axially slideable, non-rotatable movement relative to the nose portion during depth-adjusting movement of the adjustment member, and including linking means for axially moving the locator member relative to the nose portion responsive to rotation of the adjustment member;

(d) the linking means including first means operatively associated with the nose portion and the locator member for releasably restraining the locator member from rotating consequent to said rotation of the adjustment member;

(e) second means operatively associated with the nose portion and the adjustment member for releasably restraining the adjustment member from axially moving relative to the nose portion during the depth-adjusting movement of the adjustment member; and (f) the second means for restraining including an internal annular flange engageable in a snap-action with a retaining ring connected to the nose portion.

13. A depth-adusting system for a power tool having a housing, comprising:

(a) a nose portion connected to the housing, and having an axis;

(b) an adjustment member connected to the nose portion for rotatable, non-axial movement relative to the nose portion during depth-adjusting movement of the adjustment member;

(c) a locator member connected to the nose portion for axially slidable, non-rotatable movement relative to the nose portion during depth-adjusting movement of the adjustment member, and including linking means for axially moving the locator member relative to the nose portion responsive to rotation of the adjustment member;

(d) the linking means including means operatively associated with the nose portion and the locator member for releasably restraining the locator member from rotating consequent to said rotation of the adjustment member; and (e) anti-locking means for inhibiting the locator member from locking-up with the adjustment member consequent to rotational movement of the adjustment member relative to the locator member through a predetermined distance.

14. A depth-adjusting system for a power tool having a housing, comprising:

(a) a nose portion connected to the housing, and having an axis;

(b) an adjustment member connected to the nose portion for rotatable, non-axial movement relative to the nose portion during depth-adjusting movement of the adjustment member;

(c) a locator member connected to the nose portion for axially slidable, non-rotatable movement relative to the nose portion during depth-adjusting movement of the adjustment member, and including linking means for axially moving the locator member relative to the nose portion responsive to rotation of the adjustment member;

(d) the linking means including means operatively associated with the nose portion and the locator member for releasably restraining the locator member from rotating consequent to said rotation of the adjustment member; and (e) the locator member and the adjustment member being formed with accommodating structure which permits the locator member and the adjustment member to be assembled together and disassembled without destruction to the locator member and the adjustment member.

* * * * *